United States Patent [19]

Ullman, Jr.

[11] 4,107,897

[45] Aug. 22, 1978

[54] SNAP-IN PLASTIC FRAME FOR PANELS

[75] Inventor: Myron E. Ullman, Jr., Canfield, Ohio

[73] Assignee: Kessler Products Co., Inc., Youngstown, Ohio

[21] Appl. No.: 713,800

[22] Filed: Aug. 12, 1976

Related U.S. Application Data

[63] Continuation-in-part of Ser. No. 547,648, Feb. 6, 1975, abandoned.

[51] Int. Cl.[2] ..... E04C 2/38

[52] U.S. Cl. ..... 52/823

[58] Field of Search ..... 52/614, 716, 627, 628, 52/475, 623, 624; 40/152, 154, 155, 156, 10 R

[56] References Cited

U.S. PATENT DOCUMENTS

| | | | |
|---|---|---|---|
| 2,521,603 | 9/1950 | Prew | 40/152 |
| 2,777,232 | 1/1957 | Kulicke | 40/155 |
| 2,798,261 | 7/1957 | Greig | 52/614 |
| 3,055,722 | 9/1962 | Chase | 52/614 |
| 3,060,606 | 10/1962 | Peach | 40/154 |
| 3,200,526 | 8/1965 | Munn | 40/152 |
| 3,237,333 | 3/1966 | Bacharach | 40/156 |
| 3,315,431 | 4/1967 | Yake | 52/475 |
| 3,388,491 | 6/1968 | Spertus | 40/152 |
| 3,570,160 | 3/1971 | Spertus | 40/152 |

*Primary Examiner*—John E. Murtagh
*Attorney, Agent, or Firm*—Meyer, Tilberry & Body

[57] ABSTRACT

A novel extruded contoured decorative paneling strip is provided for quick installation on the front face of a panel core wherein the strip is preformed to engage the backside and one edge of a core and to engage a detent on the front face of the core. The strip is pre-mitred to compensate for flexing distortion of the contoured cross section of the strip when it is flexed to engage a detent. A novel method of pre-mitring assures a professional appearing mitre between matching contoured strips in contact with each other on the face of the core.

11 Claims, 11 Drawing Figures

SNAP-IN PLASTIC FRAME FOR PANELS

This application is a continuation-in-part application to co-pending patent application Ser. No. 547,648, filed Feb. 6, 1975, now abandoned.

Molding for rectangular panels, such as vanity tops, cabinet doors, picture mountings and the like made from strips of metal having a channel-like cross section are well known in the art. The Spertus U.S. Pat. No. 3,388,491 is an example of this type of molding wherein a single metal strip is bent into the rectangular shape of the panel to be enclosed, having first been mitred to bend at the corners of the panel. Extruded molding such as shown in the Kulicke U.S. Pat. No. 2,777,232 and in the Peach U.S. Pat. No. 3,060,606 is also known. The Kulicke device has a hook shaped cross section adapted to engage a slot on the backside of a panel, abut the edge of the panel and extend a flat portion over the edge surface of the front face of the panel. Peach is a U-shaped extrusion which depends on deflection of one of the legs of the U-shaped device to sandwich a panel therebetween. Each of these prior art moldings performs essentially the same function, i.e., to encase a panel with a plain substantially flat rectangular frame. None of these prior art moldings relate to decorative paneling strips with the three dimensional look, nor to the problems required to be solved in securely attaching such decorative panel strips to panels.

It is therefore an object of this invention to provide a novel inexpensive but attractive decorative trim strip for picture frames, cabinet doors, and similar such multi-sided panels requiring so called three dimensional decorative framing.

It is another object of this invention to provide a novel decorative trim strip for panel cores which can be assembled and disassembled without use of special tools.

It is yet another object of this invention to provide a novel decorative trim strip suitable for professional application by cabinet makers and picture framers yet within the skill of amateur craftsmen.

It is still another object of this invention to provide a novel decorative trim strip which may be easily snapped onto a panel core to make a mitred fit of professional caliber with adjacent trim strips.

It is a further object of this invention to provide novel decorative trim strips which may be readily snapped onto a panel core in a manner which stabilizes a mitred joint between strips.

It is a still further object of this invention to provide a novel method of cutting the inventive trim strip so as to provide accurate mitred fits between strips after the strips have been flexed in cross section upon being snapped into place on a panel core.

With the foregoing and other objects and features of the invention which will become evident, the invention consists of certain novel features of design and arrangement as illustrated in the accompanying drawings, and particularly pointed out in the appended claims, it being understood that various changes in the form, proportion, size and minor details of the invention may be made without departing from the spirit, or sacrificing any of the advantages of the invention.

For the purpose of facilitating an understanding of my invention, I have illustrated in the accompanying drawings preferred embodiments thereof, from an inspection of which when considered in connection with the following description, my invention, its mode of construction, assembly and application and many of its advantages should be readily understood.

Reference is now made to the drawings in which the same characters of reference are employed to indicate corresponding or similar parts throughout the several figures of the drawings in which.

Figure 1:
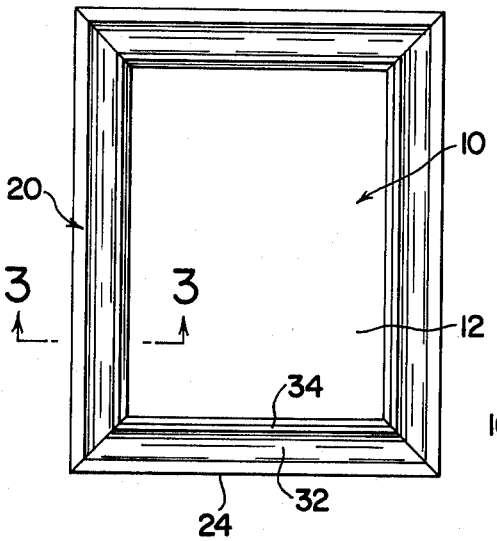
FIG. 1 is a front elevational view of a decorative panel according to the invention.
Figure 2:
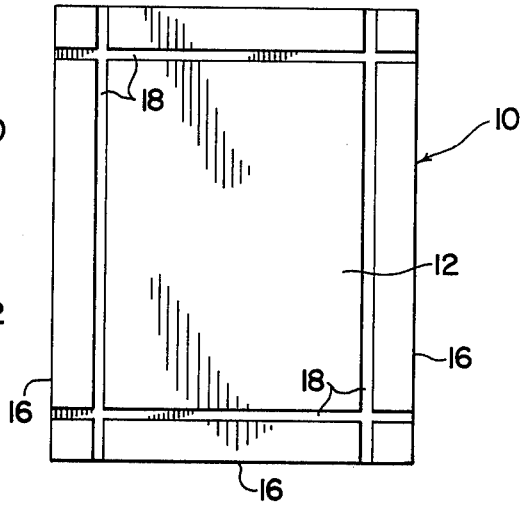
FIG. 2 is a front elevational view of a panel core in accordance with one preferred embodiment of the invention showing trim strip groove detents adapted to receive contoured decorative paneling trim strip edges.
Figure 9:
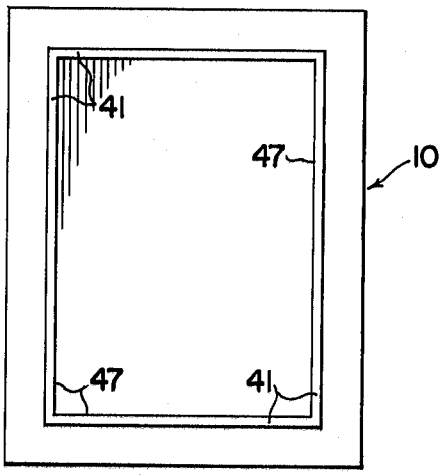
FIG. 9 is a front elevational view of a panel core showing trim strip rib detents adapted to engage contoured decorative paneling trim strip edges.
Figure 6:
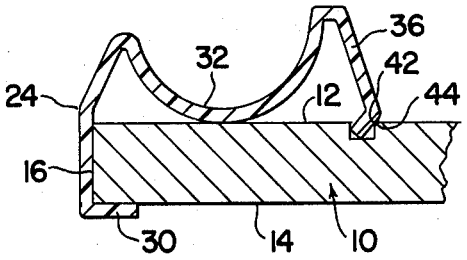
FIG. 6 is a fragmentary sectional view similar to FIG. 3, showing a modified embodiment of the invention.
Figure 3:
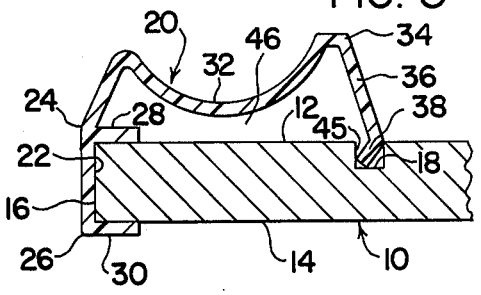
FIG. 3 is a fragmentary sectional view taken on the line 3—3 of FIG. 1.
Figure 4:
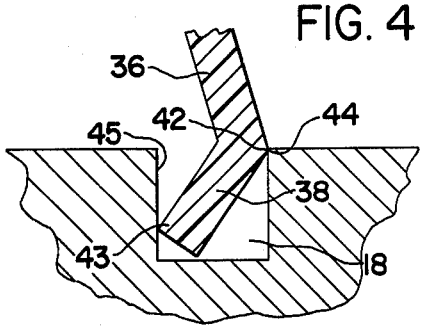
FIG. 4 is an enlarged fragmentary sectional view of a portion of FIG. 3, showing the relationship between a trip strip detent engaging finger and a panel core detent groove.
Figure 11:
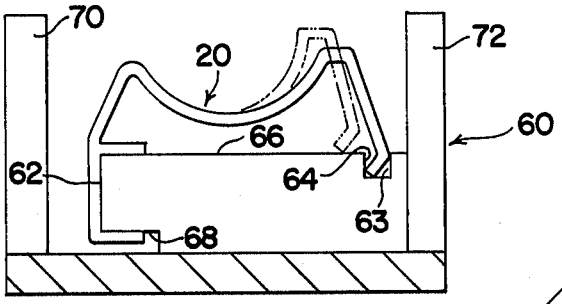
Figure 5:
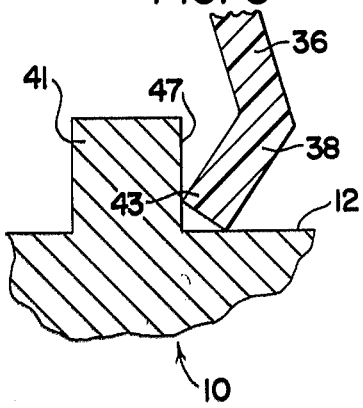
FIG. 5 is an enlarged fragmentary sectional view similar to FIG. 4 showing the relationship between a trim strip detent engaging finger and a panel core detent rib.

Referring now to the drawings in greater specificity, a preferred embodiment of the invention is shown in FIGS. 1 and 3 comprising a panel core member 10, having flat parallel front and back surfaces 12 and 14 respectively; straight sides 16; and detent grooves 18 scored on the front face 12 and parallel to sides 16. An elongated transversely flexible plastic extruded trim strip 20 has one straight flat portion 22 adapted to abut against a straight core side 16. Front and back edges 24 and 26 respectively of flat portion 22 are straight and parallel. A rib 28 extends from front edge 24 to bear against front surface 12. A rib 30 extends from back edge 26 to bear against back surface 14. The distance between ribs 28 and 30 is equal to or preferably slightly less than the distance between core surfaces 12 and 14 so as to provide a snug fit between the core 10 and the ribs 28 and 30. A decorative contoured portion 32 extends upwardly from edge 24 and then across the front surface 12 of core 10 to edge 34. Extending downwardly from edge 34 is detent engaging portion 36 terminating in a detent engaging finger 38 which engages detent groove 18. In the preferred embodiment, shown enlarged in FIG. 4, outside edge 42 of detent groove 18 is met by external edge 44 of finger 38, or preferably, as shown in FIG. 6, finger edge 44 slightly overlaps detent groove edge 42 to conceal the groove 18. In lieu of the groove detent 18, a rib 41, FIG. 5 may be secured to front surface 12, to be engaged by edge 43 of finger 38. In either event, extremity 43 of finger 38 pressure engages detent groove wall surface 45, FIG. 4, or detent rib surface 47, FIG. 5. For finger 38 to be brought into detent engagement, trim strip 20 is transversely extended by flexing to make snap-in engagement with detent groove 18 or rib 41. If detent ribs 41 are used, they, of course, would be positioned, such as shown in FIG. 9, so as not to interfere with trim strip ribs 22. FIG. 11 illustrates the flexed and unflexed cross sectional configuration of the trim strip 20.

Figure 7:
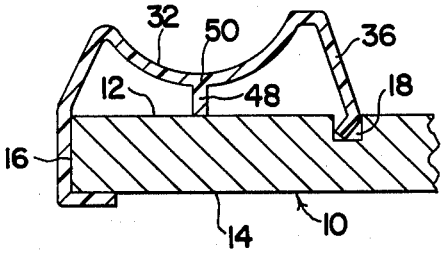
FIG. 7 is a fragmentary sectional view similar to FIG. 3, showing another embodiment of the invention.

It will be noted that a space 46 is intermediate contoured portion 32 and front surface 12, FIG. 3, to provide the three dimensional look valued in decorative panels. To emphasize the sculptured effect, contoured portion 32 may be extended downwardly to make contact with front surface 12, as shown in FIG. 6. By bringing contoured portion 32 into pressure contact with surface 12, rib 28 may be dispensed with. In FIG. 7, pressure contact is maintained with front surface 12 by rib 48 extending down from the lowermost point 50 of contoured portion 32.

Figure 8:
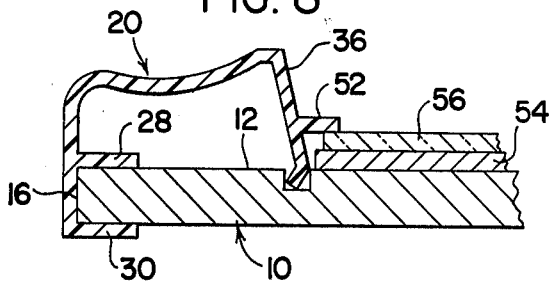
FIG. 8 is a fragmentary sectional view similar to FIG. 3, showing a special adaptation of the invention for use in picture framing.

Whereas the embodiments of FIGS. 1 through 7 are particularly suitable for decorative panels, the embodiment of FIG. 8 is particularly adapted for picture framing. The trim strip of FIG. 8 is substantially as shown and described with reference to FIGS. 1 through 7, however, a third rib 52 is provided to laterally extend from detent engaging portion 36 to grip a picture 54 and/or its mat 56 snugly between rib 52 and core front surface 12.

Figure 10:
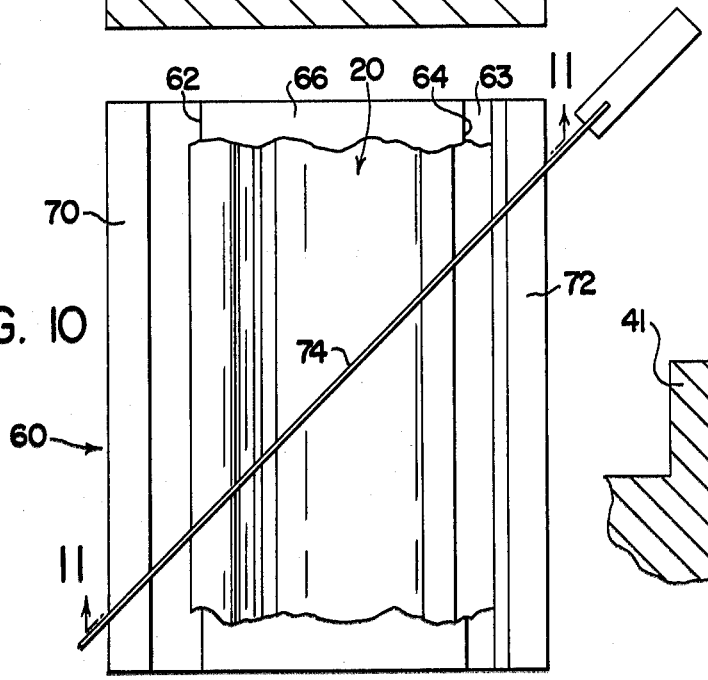
FIG. 10 is a plan view of a miter cutting fixture showing a trim strip being mitred in accordance with the invention; and, FIG. 11 is a sectional view taken along the line 11—11 of FIG. 10 showing the unflexed and flexed cross sections of the trim strip before and after engagement with the detent groove of the mitring fixture.

The distance between core side 16 and detent groove surface 45 is greater than the width of trim strip 20 measured from flat portion 22 to finger extremity 43 in its normal unflexed state. This relationship is illustrated in another context in FIG. 10 showing the trim strip flexed in solid lines and unflexed in broken lines. Accordingly, in order to snap engage finger 38 with groove 18 it is necessary to laterally extend or flex the trim strip until engagement can be made. There are a wide range of plastics well known to those skilled in the art which may be selected to provide a trim strip reasonably stiff yet sufficiently flexible for the purpose of this invention. An important basis of selection is that the plastic have a sufficiently satisfactory modulus of elasticity that the trim strip is maintained in tension between the core side 16 and the groove wall surface 45. The same dimensional relationships also exist between the core 10 and the trim strip 20 with the use of a rib detent 41 wherein the same resultant dynamic relationship exists therebetween.

In order to obtain a mitre fit of professional quality between adjacent trim strips, the strip must be cut in its flexed state. For this purpose a fixture 60, FIGS. 10 and 11, includes simulated core side 62, simulated detent groove 63 and wall 64 and simulated core front and back surfaces 66 and 68 respectively, which have the same dimensions and dimensional relationships as core side 16, detent groove 18, wall 45 and core front and back surfaces 12 and 14. Mitre cutting blade guides 70 and 72 hold mitre blade 74 in proper cutting alignment. After the trim strip 20 has been cut under tension as shown in FIG. 10, removal and re-engagement with an actual core results in perfect alignment between trim strip abutting mitred edges.

It is believed that the invention, its mode of fabrication and assembly and its advantages will be understood from the foregoing description, and it is further believed that while several preferred embodiments of the invention have been shown and described for illustrative purposes, the structural details are nevertheless capable of variation within the intent and scope of the invention as defined in the appended claims.

Having thus described the invention, it is claimed:

1. A contoured decorative trim strip for a panel core having flat parallel front and back surfaces, straight sides, and detents on the front surface parallel to said side surfaces comprising: an elongated extrusion having one straight flat portion adapted to abut against a straight side of said panel; said flat portion having a first rib extending from said flat portion to engage the back surface of said panel; a second rib parallel to and spaced apart from said first rib extending from said flat portion to engage the front surface of said panel; a flexible decorative generally convex contoured portion extending from the front edge of said flat portion to project over the front surface of said core to define an enclosed space thereunder; finger means projecting downwardly from said decorative contoured portion remote from said front edge adapted to engage a panel detent when said contoured portion is flexed and thereby extended against said panel; said strip being mitred at opposite ends to align with like adjacent mitred strips when also flexed into detent engagement with said panel.

2. The strip of claim 1 wherein said contoured portion is adapted to be spaced above the front surface of said core.

3. The strip of claim 1 wherein said contoured portion is fluted.

4. The strip of claim 1 wherein the front surface of said contoured portion is partially concave.

5. The strip of claim 1 wherein the front surface of said contoured portion is convex.

6. The strip of claim 1 wherein the front surface of said contoured portion is concave-convex.

7. The strip of claim 1 wherein said finger means is adapted to conceal said panel detent.

8. The strip of claim 1 wherein said finger means is adapted to bear against the outside edge of said detent.

9. The strip of claim 1 wherein said finger means is adapted to bear against the inside wall of said detent.

10. The strip of claim 1 wherein said finger means is adapted to bear against the outside edge and inside wall of said groove.

11. The panel of claim 1 wherein said contoured portion is spaced above the front surface of said core.

* * * * *

UNITED STATES PATENT AND TRADEMARK OFFICE

CERTIFICATE OF CORRECTION

PATENT NO. : 4,107,897

DATED : August 22, 1978

INVENTOR(S) : Myron E. Ullman, Jr.

It is certified that error appears in the above-identified patent and that said Letters Patent are hereby corrected as shown below:

Column 3, line 9, reference numeral "22" should read -- 28 --;

line 35, "FIG. 10" should read -- FIG. 11 --.

Column 4, line 53, after "wherein" insert -- said detent comprises a groove and --;

Line 56, "panel" should read -- trim strip --.

Signed and Sealed this

*Eleventh* Day of *December 1979*

[SEAL]

*Attest:*

SIDNEY A. DIAMOND

*Attesting Officer*

*Commissioner of Patents and Trademarks*